US009574824B2

(12) United States Patent
Lee et al.

(10) Patent No.: US 9,574,824 B2
(45) Date of Patent: Feb. 21, 2017

(54) LAUNDRY TREATMENT APPARATUS

(71) Applicant: LG Electronics Inc., Seoul (KR)

(72) Inventors: Sangik Lee, Seoul (KR); Jeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 14/138,855

(22) Filed: Dec. 23, 2013

(65) Prior Publication Data

US 2014/0182157 A1 Jul. 3, 2014

(30) Foreign Application Priority Data

Dec. 31, 2012 (KR) ..... 10-2012-0157983

(51) Int. Cl.
*F26B 21/00* (2006.01)
*D06F 58/22* (2006.01)

(52) U.S. Cl.
CPC ..... *F26B 21/003* (2013.01); *D06F 58/22* (2013.01)

(58) Field of Classification Search
CPC ..... F26B 21/003; D06F 8/22
See application file for complete search history.

(56) References Cited

U.S. PATENT DOCUMENTS 8,156,659 B2 4/2012 Jung
8,387,268 B2 3/2013 Ahn
2008/0196268 A1 8/2008 Jung
2010/0154241 A1 6/2010 Ahn
2011/0154587 A1 6/2011 Kim
2011/0225838 A1* 9/2011 Ahn ..... D06F 58/22 34/82
2014/0157621 A1 6/2014 Kim

FOREIGN PATENT DOCUMENTS

CN 2448866 Y 9/2001
CN 101311407 A 11/2008
CN 101760944 A 6/2010
CN 102099524 6/2011
CN 103866528 A 6/2014
(Continued)

OTHER PUBLICATIONS

Chinese Office Action dated Jul. 3, 2015 for Chinese Appln. No. 201310751093.7, with English Translation, 20 Pages.
(Continued)

*Primary Examiner* — Jiping Lu
(74) *Attorney, Agent, or Firm* — Fish & Richardson P.C.

(57) ABSTRACT

A laundry treatment apparatus includes a connection duct into which air inside a drum, in which laundry is received, is discharged, and a discharge duct that extends in a longitudinal direction of the drum and that is connected to the connection duct. The laundry treatment apparatus also includes a filter assembly that has a filter unit located in the discharge duct and configured to filter air introduced into the discharge duct and an impurity remover unit configured to separate, from the filter unit, impurities remaining on the filter unit. The laundry treatment apparatus further includes an impurity storage device separable from the discharge duct. The impurity storage device is located below the filter unit and configured to store impurities separated from the filter unit by the impurity remover unit.

18 Claims, 10 Drawing Sheets

(56) References Cited

FOREIGN PATENT DOCUMENTS

| | | | | |
|---|---|---|---|---|
| DE | 10 2008 009780 | A1 | | 8/2008 |
| EP | 2 341 182 | A1 | | 7/2011 |
| JP | 07136396 | A | * | 5/1995 |
| WO | WO 2011/139095 | A2 | | 11/2011 |

OTHER PUBLICATIONS

Office Action issued in Chinese Application No. 201310751093.7 on Jan. 15, 2016, 17 pages (with English translation).
European Search Report dated Mar. 28, 2014 for Application No. 13199464.2, 7 pages.

* cited by examiner (a)

(b)

(a)

(b)

(a)

(b)

LAUNDRY TREATMENT APPARATUS

This application claims the benefit of Korean Patent Application No. 10-2012-0157983, filed on Dec. 31, 2012, which is hereby incorporated by reference as if fully set forth herein.

FIELD

The present disclosure relates to a laundry treatment apparatus.

BACKGROUND

A laundry treatment apparatus is a generic term for home appliances including a washing machine for washing laundry, a dryer for drying laundry, and a combined drying and washing machine for both washing and drying laundry.

In addition, a laundry treatment apparatus capable of drying laundry (e.g., washed clothing) may be classified into an exhaust type laundry treatment apparatus and a circulation type laundry treatment apparatus.

More specifically, a laundry treatment apparatus may be classified into the exhaust type laundry treatment apparatus which is configured to exhaust hot and humid air discharged from a drum to the outside of the laundry treatment apparatus, and the circulation type laundry treatment apparatus that uses a heat exchanger that implements condensation and heating of air discharged from the drum while hot and humid air discharged from the drum is resupplied into the drum (e.g., during circulation of air discharged from the drum).

The air discharged from the drum during drying may contain impurities (e.g., lint, etc.) dropped from an object to be dried, such as laundry. Accumulation of the impurities on internal components of the laundry treatment apparatus may cause breakdown of the laundry treatment apparatus, and the impurities discharged outward from the laundry treatment apparatus may cause air contamination of an indoor space where the laundry treatment apparatus is placed. Therefore, laundry treatment apparatus having a drying function may remove the impurities from the air discharged from the drum.

A laundry treatment apparatus having a drying function may include a connection duct arranged in a height direction of a drum, and a discharge duct arranged in a longitudinal direction of the drum. The connection duct may be provided with a filter to filter air discharged from the drum.

SUMMARY

In one aspect, a laundry treatment apparatus includes a cabinet defining an external appearance of the laundry treatment apparatus, a drum rotatably supported within the cabinet and configured to receive laundry therein, a connection duct into which air inside the drum is discharged, and a discharge duct that extends in a longitudinal direction of the drum and that is connected to the connection duct. The laundry treatment apparatus also includes a filter assembly that has a filter unit located in the discharge duct and configured to filter air introduced into the discharge duct and an impurity remover unit configured to separate, from the filter unit, impurities remaining on the filter unit. The laundry treatment apparatus further includes an impurity storage device that is located at the discharge duct and that is separable from the discharge duct. The impurity storage device is located below the filter unit and is configured to store impurities separated from the filter unit by the impurity remover unit.

Implementations may include one or more of the following features. For example, the cabinet may have a storage device insertion hole that communicates with the discharge duct and the impurity storage device may pass through the storage device insertion hole based on the impurity storage device being inserted into the discharge duct or separated from the discharge duct. In this example, the discharge duct may include a duct connection hole located above the filter unit, where air is introduced from the connection duct into the discharge duct through the duct connection hole, and a discharge hole located below the filter unit, where air having passed through the filter unit is discharged from the discharge duct to outside of the cabinet through the discharge hole.

In some implementations, the filter assembly may include a first roller and a second roller rotatably supported within the discharge duct and configured to allow movement of the filter unit above the impurity storage device. In these implementations, the first roller may include a first roller body rotatably secured within the discharge duct and first roller bosses radially protruding from an outer peripheral surface of the first roller body and the second roller may include a second roller body rotatably secured within the discharge duct and second roller bosses radially protruding from an outer peripheral surface of the second roller body. Further, in these implementations, the filter unit may include a filter having a cylindrical shape with opposite sides that are open, the filter being supported by the first roller and the second roller, and fastening holes defined in the filter such that the first roller bosses and the second roller bosses are inserted into the fastening holes. The impurity remover unit may include a scraper that is secured to the impurity storage device and arranged to contact the filter.

In some examples, the filter unit may include a filter frame secured within the discharge duct, an impurity discharge aperture defined in the filter frame at a position above the impurity storage device, and a filter secured to the filter frame and configured to filter air passing through the discharge duct. In these examples, the impurity remover unit may be configured to reciprocate along the filter frame and move impurities remaining on the filter to the impurity discharge aperture. Also, in these examples, the impurity remover unit may include a brush located on the filter and arranged to contact the filter, a brush rack placed within the discharge duct and configured to move in a longitudinal direction of the filter frame, the brush being secured to the brush rack, a brush motor gear placed within the discharge duct and configured to allow the brush rack to move in a longitudinal direction of the filter frame, a brush motor provided at an exterior of the discharge duct, and a rotating shaft that is provided at the brush motor, that penetrates the discharge duct, and that serves to rotate the brush motor gear based on force generated by the brush motor.

The impurity remover unit may include a brush rack gear configured to connect the brush rack and the brush motor gear to each other and the brush rack may include a first brush rack and a second brush rack provided respectively at opposite sides of the filter frame. In addition, the brush rack gear may include a first brush rack gear configured to couple the first brush rack and the brush motor gear to each other and a second brush rack gear engaged with the second brush rack. The first brush rack gear and the second brush rack gear may be connected to each other via a connection shaft.

In some implementations, the filter assembly may include a scraper provided at an outer periphery of the impurity discharge aperture or inside the impurity discharge aperture to separate, from the brush, impurities remaining on the brush. The scraper may be provided at an outer periphery of the impurity discharge aperture. The scraper may be provided inside the impurity discharge aperture. The discharge duct may include a rack guide located below the filter frame and configured to assist the brush rack in being received in the discharge duct.

In some examples, the discharge duct may include a slit that extends in a longitudinal direction of the filter frame and the impurity remover unit may include a brush motor provided at an exterior of the discharge duct, a rotating shaft provided at the brush motor and inserted into the discharge duct through the slit, a brush located within the discharge duct and arranged to contact an upper portion of the filter, the rotating shaft penetrating the brush, a brush rack that is located within the discharge duct and that extends in a longitudinal direction of the filter frame, and a brush motor gear placed within the discharge duct and engaged with the brush rack, the brush motor gear being secured to the rotating shaft. In these examples, the brush rack may include a first brush rack and a second brush rack that are provided at opposite sides of the filter frame and that extend in a longitudinal direction of the filter frame. Further, in these examples, the brush motor gear may include a first brush motor gear engaged with the first brush rack and a second brush motor gear engaged with the second brush rack.

In some implementations, the impurity storage device may include a housing separable from the discharge duct, the housing being located below the impurity discharge aperture, a compression unit located in the housing and configured to compress impurities introduced into the housing through the impurity discharge aperture, and a compression unit drive unit configured to reciprocate the compression unit within the housing. In these implementations, the compression unit may include a compression plate located within the housing and a shaft support portion secured to the compression plate such that the compression unit drive unit is connected to the shaft support portion. The compression unit drive unit may include a motor located at an exterior of the housing, that has a rotating shaft configured to penetrate the housing, and that is rotatably secured to the shaft support portion, a motor gear coupled to the rotating shaft and located at the exterior of the housing, and a rack that is provided at the exterior of the housing and that extends in a longitudinal direction of the housing, the rack being engaged with the motor gear. Through-holes may be defined in the compression plate.

In addition, the laundry treating apparatus may include a sensor configured to sense whether the compression unit reaches a reciprocation threshold position to indicate whether a maximum quantity of impurities are stored in the housing. Further, the laundry treating apparatus may include a first sensor configured to sense whether the compression unit reaches a first reciprocation threshold position to indicate whether the housing is located in the discharge duct and a second sensor configured to sense whether the compression unit reaches a second reciprocation threshold position to indicate whether a maximum quantity of impurities are stored in the housing.

DETAILED DESCRIPTION

Figure 1:
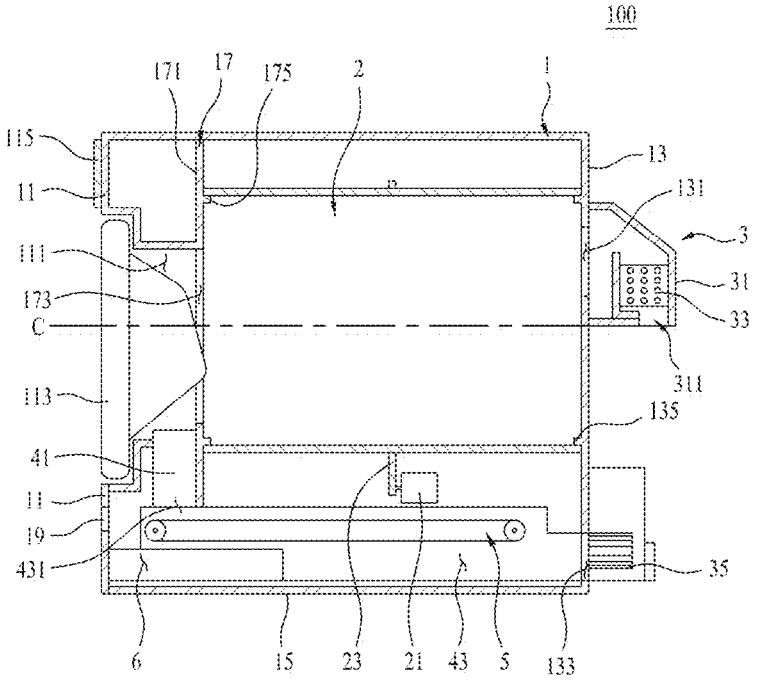
FIG. 1 is a view showing an example of a laundry treatment apparatus.

A laundry treatment apparatus 100, as shown in FIG. 1, includes a cabinet 1 defining an external appearance of the laundry treatment apparatus 100, a drum 2 rotatably placed within the cabinet 1, the drum 2 being configured to receive laundry therein, an air supply unit 3 configured to supply heated air (e.g., hot air) or unheated air into the drum 2, a discharge path (4, see FIG. 3) configured to discharge air outwardly from the drum 2, a filter assembly 5 configured to remove impurities from the air discharged from the drum 2, and an impurity storage device 6 in which impurities filtered via the filter assembly 5 are stored, the impurity storage device 6 being separable from the cabinet 1.

The cabinet 1 is constituted of a front panel 11 having an opening 111, a rear panel 13 having an air inlet 131 that communicates with the interior of the drum 2, and a base panel 15 located below the drum 2. The front panel 11 and the rear panel 13 are supported by the base panel 15.

A user may put or take laundry into or out of the drum 2 through the opening 111. The opening 111 is opened or closed by a door 113 that is rotatably secured to the front panel 11.

A control panel 115 may be attached to the front panel 11. The control panel 115 is provided with an input unit that allows the user to input control instructions to the laundry treatment apparatus 100 and a display unit that displays control details of the laundry treatment apparatus 100.

The rear panel 13 is located opposite to the front panel 11 so as to face the front panel 11 (e.g., at a position spaced apart from the front panel 11 by a predetermined distance in a longitudinal direction of the drum 2). The air inlet 131 is perforated in the rear panel 13 to allow air supplied from the air supply unit 3 to be introduced into the drum 2.

The rear panel 13 may further have an air outlet 133, through which the air discharged from the drum 2 through the discharge path 4 moves outward from the cabinet 1.

The rear panel 13 may further have a rear support flange 135 configured to rotatably support a rear surface of the drum 2. This will be described later in more detail.

The base panel 15 serves to support the laundry treatment apparatus 100 on the ground. The front panel 11 and the rear panel 13 are secured to the base panel 15.

Figure 2:
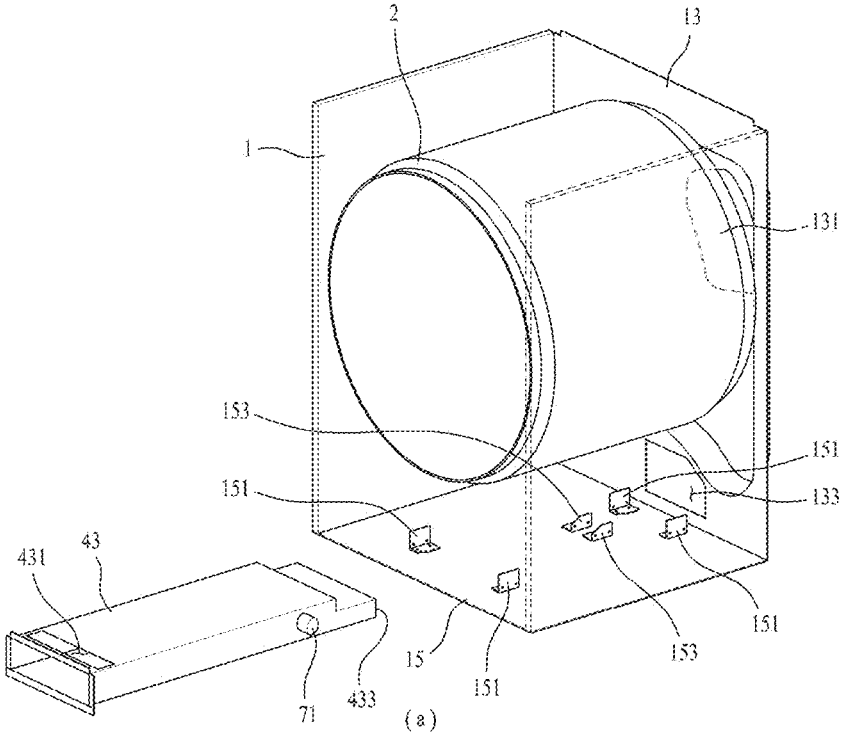
FIGS. 2(*a*) and 2(*b*) are views showing an example coupling configuration of an example base panel and an example discharge duct.
Figure 2:
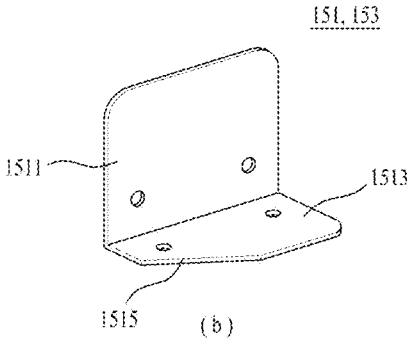

The base panel 15 may have duct guides 151 and 153 (see FIG. 2(*a*)) configured to facilitate assembly of a discharge duct 43 provided in the discharge path 4 and the air outlet 133 perforated in the rear panel 13. This will be described later in detail.

A drum support structure 17 is further provided within the cabinet 1 to rotatably support a front surface of the drum 2. The drum support structure 17 includes a support body 171 secured to an inner surface of the cabinet 1 and a support structure through-hole 173 perforated in the support body 171 for communication between the opening 111 and the interior of the drum 2.

Accordingly, laundry introduced into the cabinet 1 through the opening 111 may move into the drum 2 through the support structure through-hole 173.

The drum support structure 17 may further include a front support flange 175 configured to rotatably support the front surface of the drum 2. The front support flange 175 is formed at an outer periphery of the support structure through-hole 173.

In this case, the diameter of the front support flange 175 may be greater than the diameter of the support structure through-hole 173 in consideration of the diameter of the drum 2.

The drum 2 may have the shape of a cylinder, the front surface and the rear surface of which are open. As described above, the front surface of the drum 2 is rotatably supported by the front support flange 175, and the rear surface of the drum 2 is rotatably supported by the rear support flange 135.

A drum drive unit is provided to rotate the drum 2. The drum drive unit may include a drum motor 21, and a belt 23 that connects a rotating shaft of the drum motor 21 and an outer peripheral surface of the drum 2 to each other.

The air supply unit 3 serves to supply heated air or unheated air into the drum 2 to allow heat exchange between laundry and the air. The air supply unit 3 may include a heater housing 31 formed at the rear panel 13, a heater (e.g., a device configured to increase temperature of air flowing through the heater housing 31) 33 accommodated in the heater housing 31, and a fan 35 located in the discharge path 4 (more particularly, located in a connection duct 41 or the discharge duct 43).

The heater housing 31 is configured to enclose the air inlet 131 perforated in the rear panel 13, and has a housing inlet 311 for introduction of air into the heater housing 31.

Providing the heater housing 31 at the exterior of the cabinet 1 rather than the interior of the cabinet 1 further increases the drying capacity of laundry.

If the quantity of laundry increases, it is necessary to supply a greater quantity of air into the drum 2 to achieve drying of laundry within a predetermined time. Accordingly, to dry a great quantity of laundry, the laundry treatment apparatus 100 needs to increase the quantity of air to be supplied into the drum 2, and must employ a large capacity heater that may heat a great quantity of air.

If the large capacity heater is placed within the cabinet 1, however, the volume of the cabinet 1 is increased. Moreover, the large capacity heater may increase an internal temperature of the cabinet 1, which may cause damage to internal components within the laundry treatment apparatus 100.

To address these issues, in the laundry treatment apparatus 100, the air supply unit 3 is secured to the exterior of the cabinet 1. As such, the laundry treatment apparatus 100 may be utilized as a commercial laundry treatment apparatus that is capable of drying large amounts of laundry per load.

The discharge path 4, as described above, serves to discharge air inside the drum 2 to the outside of the cabinet 1. The discharge path 4 may include the connection duct 41 arranged in a height direction of the drum 2 (e.g., perpendicular to a rotating axis C of the drum 2), and the discharge duct 43 arranged in a longitudinal direction of the drum 2 (e.g., parallel to the rotating axis C of the drum 2), through which air supplied from the connection duct 41 is discharged outward from the cabinet 1.

The connection duct 41 is located below the opening 111 (e.g., in front of the support structure through-hole 173), and serves to move air inside the drum 2 to the discharge duct 43. That is, the connection duct 41 connects an outer periphery of the opening 111 and a duct connection hole (431, see also FIG. 2(*a*)) of the discharge duct 43 to each other.

The discharge duct 43 is configured to connect the connection duct 41 and the air outlet 133 to each other, and serves to discharge the air discharged from the drum 2 through the connection duct 41 to the outside of the cabinet 1.

To this end, the discharge duct 43 may have the duct connection hole 431 to which the connection duct 41 is coupled, and a discharge hole 433 (see FIG. 2(*a*)) that communicates with the air outlet 133.

The duct connection hole 431 may be located above the filter assembly 5 and the discharge hole 433 may be located below the filter assembly 5, such that air introduced through the duct connection hole 431 moves to the discharge hole 433 by way of the filter assembly 5.

In this case, the fan 35 included in the air supply unit 3 may be secured to the exterior of the cabinet 1 to suction air inside the discharge duct 43.

To dry a large quantity of laundry, as described above, large air volume may be needed. However, installing a large capacity fan within the cabinet 1 having a limited volume may be difficult.

Accordingly, as shown in FIG. 1, the fan 35 is secured to the rear panel 13 to outwardly discharge air inside the drum 2 through the air outlet 133, which enables installation of a large capacity fan without change in the size of the cabinet 1.

The discharge duct 43, as shown in FIG. 2(*a*), is generally assembled with the base panel 15 after the drum 2 is assembled with the cabinet 1.

In this case, for assembly of the discharge duct 43, a worker needs to push the discharge duct 43 from the front side of the drum 2 toward the rear panel 13 in order to couple the discharge duct 43 into the air outlet 133 of the rear panel 13. However, if the drum 2 obstructs a worker's field of vision, the worker may have difficulty in coupling the discharge duct 43 into the air outlet 133.

Accordingly, as shown in FIG. 2(*a*), the base panel 15 may be provided with the duct guides 151 and 153 to facilitate coupling of the discharge hole 433 of the discharge duct 43 and the air outlet 133.

The duct guides may include at least one pair of position guides 151 and at least one height guide 153. The position guides 151 assist in positioning both lateral sides of the discharge hole 433 to coincide with both lateral sides of the air outlet 133, and the at least one height guide 153 assists in positioning the top and bottom of an outer periphery of the discharge hole 433 to coincide with the top and bottom of an outer periphery of the air outlet 133.

Providing the position guide 151 and the height guide 153 with the same configuration may be advantageous in terms of reduction of manufacturing costs. To this end, as shown in FIG. 2(*b*), each of the position guide 151 and the height guide 153 may consist of a first plate 1511 and a second plate 1513 extending perpendicular to the first plate 1511, the second plate 1513 having a slope 1515.

The position guide 151 is secured to the base panel 15 via the second plate 1513, whereas the height guide 153 is secured to the base panel 15 via the first plate 1511.

Accordingly, once the discharge duct 43 is inserted into a space defined by the pair of position guides 151, both lateral sides of the discharge duct 43 may be moved to positions where both lateral sides of the discharge hole 433 coincide with both lateral sides of the air outlet 133 under guidance of the first plates 1511 of the position guides 151.

While the discharge duct 43 is moved toward the air outlet 133, the bottom of the outer peripheral surface (e.g., a bottom surface) of the discharge duct 43 is adjustable in height by the slope 1515 of the height guide 153. In this manner, the top and bottom of the outer periphery of the discharge hole 433 may coincide with the top and bottom of the outer periphery of the air outlet 133.

If the width of the discharge duct 43 is not constant (see FIG. 7), the position guides 151 may include a pair of front position guides arranged on the base panel 15 at the front side of the discharge duct 43, and a pair of rear position guides arranged on the base panel 15 at the rear side of the discharge duct 43 (e.g., arranged at positions adjacent to the air outlet 133).

In this case, the pair of front position guides are spaced apart from each other by a distance corresponding to the front width of the discharge duct 43, and the pair of rear position guides are spaced apart from each other by a distance corresponding to the rear width of the discharge duct 43.

The filter assembly 5 included in the laundry treatment apparatus 100 is arranged in a direction parallel to the rotating axis C of the drum 2 (e.g., in a longitudinal direction of the drum 2) to filter air discharged from the drum 2.

More specifically, the filter assembly 5 included in the laundry treatment apparatus 100 is located in the discharge duct 43, rather than the connection duct 41, thereby filtering air discharged from the drum 2.

In some laundry treatment apparatus, the connection duct 41 is provided with a filter. However, the length of the connection duct 41 is not variable so long as the height of the laundry treatment apparatus is not varied, which may make it difficult to increase the filtration capacity of the filter.

In some implementations, the laundry treatment apparatus 100 may achieve a significant increase in the filtration capacity of the filter assembly 5 because the filter assembly 5 is provided in the discharge duct 43 extending in a longitudinal direction of the drum 2 (e.g., parallel to the rotating axis C of the drum 2).

Accordingly, the laundry treatment apparatus 100 may be utilized as a commercial laundry treatment apparatus that is capable of drying large amounts of laundry per load.

In some examples, the impurity storage device 6, in which impurities filtered via the filter assembly 5 are stored, is provided below the filter assembly 5. The impurity storage device 6 may be retractable from the discharge duct 43. To this end, the front panel 11 is provided with a filter support panel 19.

Figure 3:
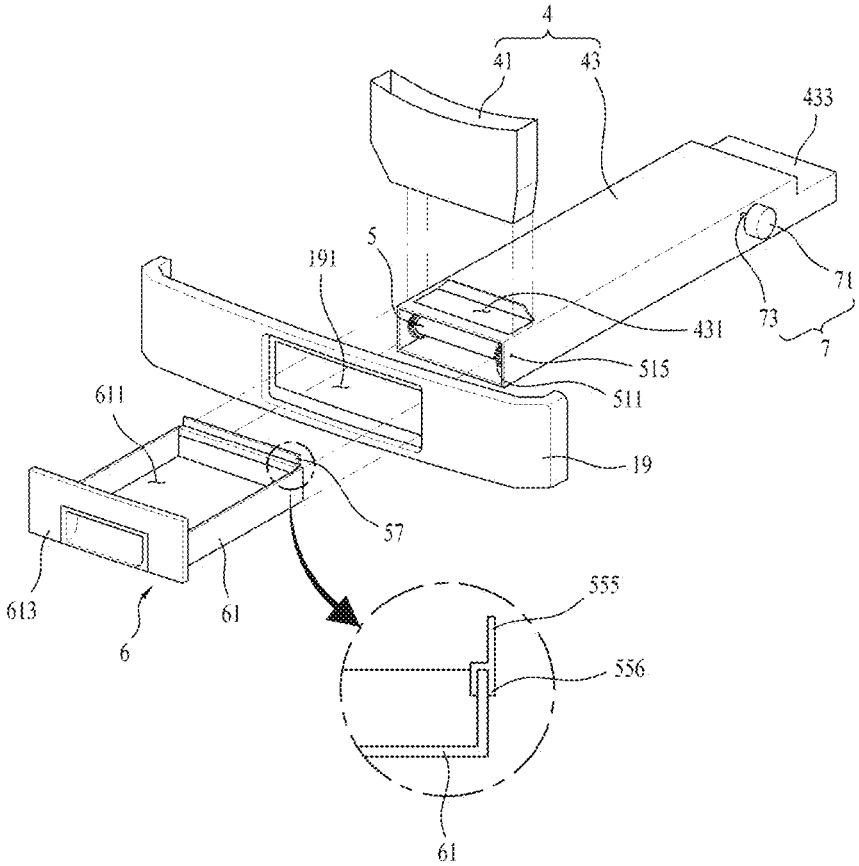
FIG. 3 is a view showing an example discharge duct, an example impurity storage device, and an example filter support panel.

More specifically, as shown in FIG. 3, the filter support panel 19 may have a storage device insertion hole 191 that communicates with the discharge duct 43 such that the impurity storage device 6 may be inserted into the discharge duct 43 through the storage device insertion hole 191. The filter support panel 19 may be located below the front panel 11 (e.g., below the door 13).

Hereinafter, configurations of the filter assembly 5 and the impurity storage device 6 will be described with reference to FIGS. 3 and 4.

The filter assembly 5 may include a first roller 51 and a second roller 53 which are rotatably placed within the discharge duct 43, and a filter unit 55 adapted to be moved via rotation of the first roller 51 and the second roller 53.

The first roller 51 may include a first roller body 511 having a cylindrical shape and rotatably secured within the discharge duct 43, and first roller bosses 513 radially protruding from an outer peripheral surface of the first roller body 511.

The first roller body 511 may be located above the impurity storage device 6 at a position between a front surface of the discharge duct 43 facing the filter support panel 19 and the duct connection hole 431.

The second roller 53 may include a second roller body 531 having a cylindrical shape and spaced apart from the first roller 51 by a predetermined distance so as to be located adjacent to the discharge hole 433 of the discharge duct 43, and second roller bosses 533 radially protruding from an outer peripheral surface of the second roller body 531.

The second roller body 531 may be rotatably placed within the discharge duct 43. As such, at least one of the first roller 51 and the second roller 53 is rotated by a drive unit 7.

The drive unit 7 may include a motor 71 secured to the exterior of the discharge duct 43, and a rotating shaft 73 provided at the motor 71, the rotating shaft 73 being installed to penetrate the discharge duct 43 to thereby be coupled to the first roller body 511 or the second roller body 531.

Figure 4:
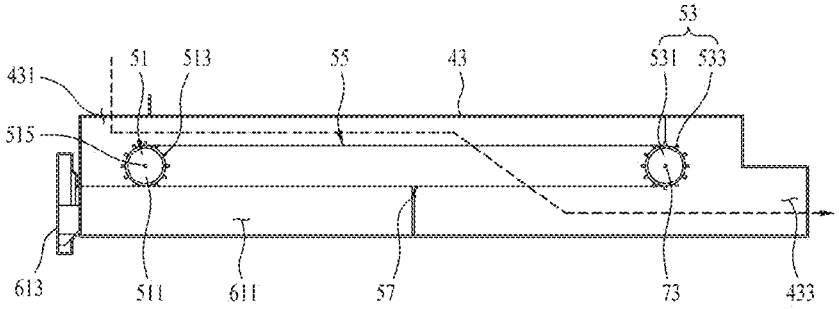
FIGS. 4, 5(*a*), and 5(*b*) are views showing an example filter assembly and an example impurity storage device.

FIGS. 3 and 4 show an example in which the rotating shaft 73 of the motor 71 is coupled to the second roller body 531. In this example, the first roller 51 may further include a body rotating shaft 515 configured to rotatably secure the first roller body 511 to the discharge duct 43.

Figure 5:
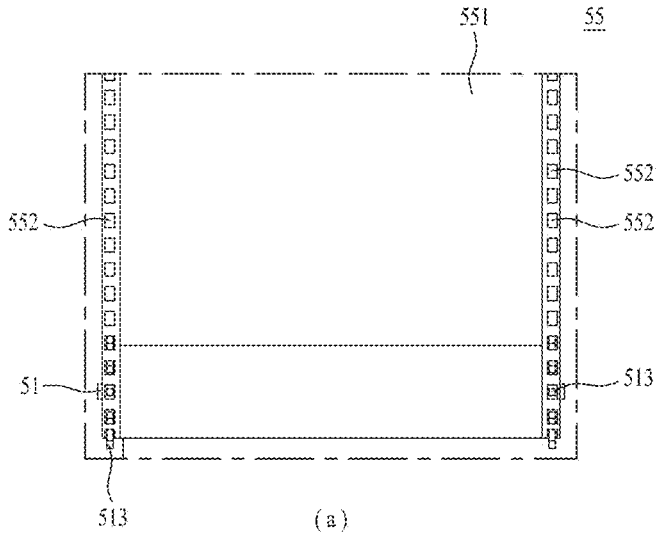
Figure 5:
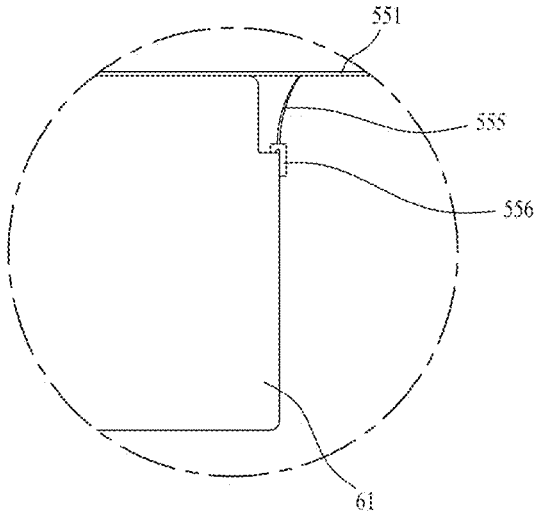

The filter unit 55, as shown in FIGS. 5(*a*) and 5(*b*), may include a filter 551 having a cylindrical shape (e.g., a belt shape), opposite sides of which are open, the filter 551 being supported by the first roller 51 and the second roller 53, and fastening holes (552, see FIG. 5(*a*)) formed in opposite ends of the filter 551 for insertion of the first roller bosses 513 and the second roller bosses 533.

The fastening holes 552 are arranged in a longitudinal direction of the filter 551 at a given interval that is determined to ensure insertion of the first roller bosses 513 and the second roller bosses 533 during rotation of the first roller 51 and the second roller 53.

Since the first roller 51 and the second roller 53 are located above the impurity storage device 6, the filter 551 will be moved in a rotating direction of the rollers 51 and 53 above the impurity storage device 6 if the second roller 53 is rotated by the drive unit 7.

More specifically, a lower portion of the filter 551 located adjacent to the impurity storage device 6 will be moved from the duct connection hole 431 toward the discharge hole 433, and an upper portion of the filter 551 located adjacent to a ceiling surface of the discharge duct 43 will be moved from the discharge hole 433 toward the duct connection hole 431.

In addition, the filter assembly 5 may further include an impurity remover unit 57 (see FIGS. 3 and 4) which serves to remove impurities remaining on the filter 551 and to move the impurities to the impurity storage device 6 located below the filter 551. The impurity remover unit 57 may be secured to the discharge duct 43, or may be secured to the impurity storage device 6 as shown in FIG. 3.

The impurity storage device 6 is retractable from the discharge duct 43 through the storage device insertion hole 191. The impurity storage device 6 may include a housing 61 defining a storage space 611 in which impurities are stored, and a handle 613 formed at the housing 61.

In this case, the impurity remover unit 57 may be secured to a surface of the housing 61 facing the discharge hole 433 so as to come into contact with the filter 551 (more particularly, the lower portion of the filter 551).

More specifically, as shown in FIGS. 3 and 5(*b*), the impurity remover unit 57 may include a housing coupling portion 556 secured to a rear surface of the housing 61, and a scraper 555 secured to the housing coupling portion 556 so as to come into contact with the filter 551 (more particularly, the lower portion of the filter 551).

Accordingly, if air discharged from the drum 2 is introduced into the discharge duct 43 through the connection duct 41 and the duct connection hole 431, the air first passes through the filter 551, and thereafter is discharged outward from the cabinet 1 through the discharge hole 433.

In this case, the majority of impurities contained in the air will be filtered by the filter 551 (more particularly, the upper portion of the filter 551 adjacent to the duct connection hole 431) arranged adjacent to the ceiling surface of the discharge duct 43. Thus, the impurities will remain on the upper portion of the filter 551.

If the second roller 53 is rotated by the drive unit 7, the upper portion of the filter 551 is moved toward the housing 61 and the scraper 555 installed to come into contact with the filter 551 separates impurities remaining on the filter 551 from the filter 551. As such, the impurities filtered by the filter 551 may be moved into the storage space 611 of the housing 61.

Figure 6:
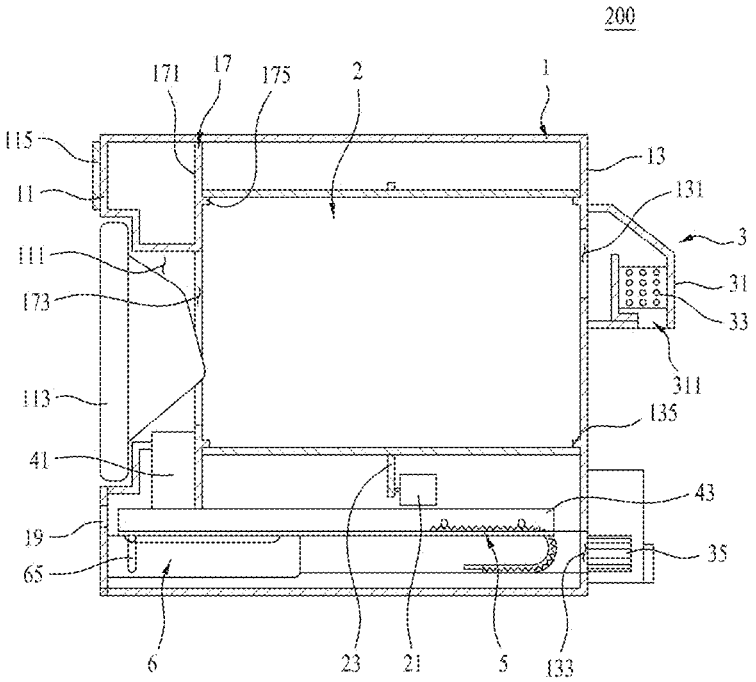
FIG. 6 is a view showing another example laundry treatment apparatus.

FIG. 6 illustrates another example laundry treating apparatus 200. The laundry treatment apparatus 200 is different from the laundry treating apparatus 100 shown in FIG. 1 in terms of configurations of the filter assembly 5 and the impurity storage device 6, and thus the following description will focus on the configurations of the filter assembly 5 and the impurity storage device 6.

Figure 7:
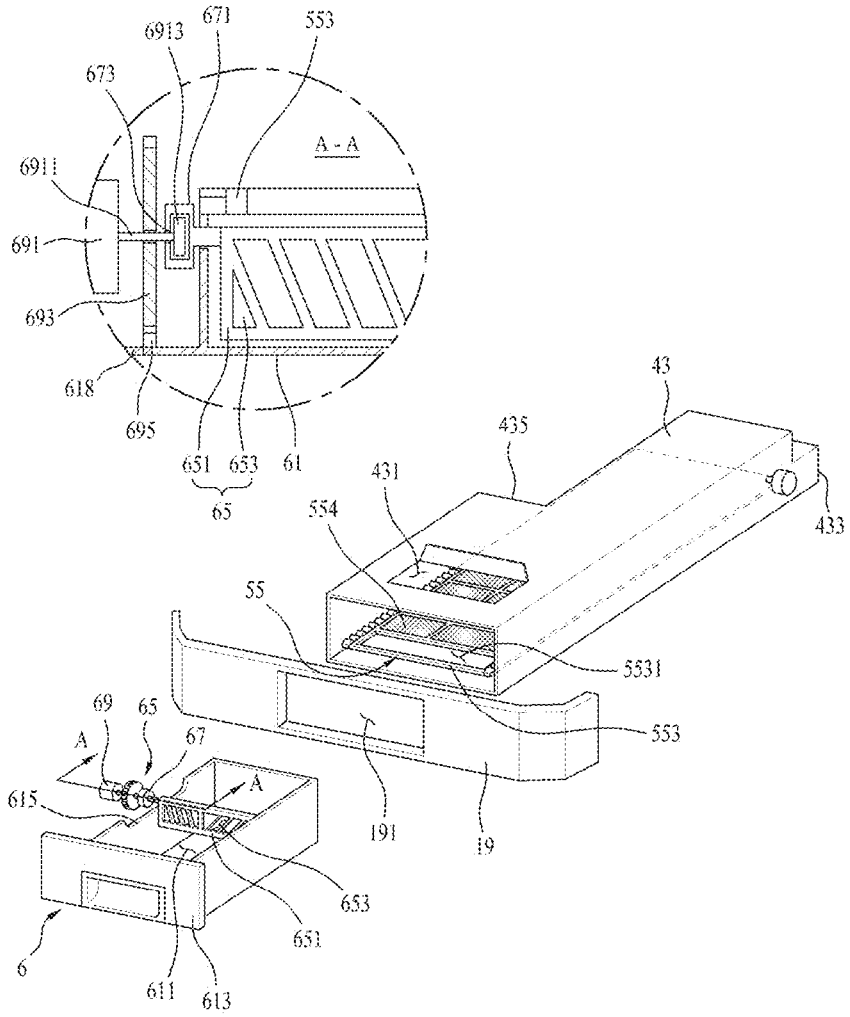
FIGS. 7, 8(*a*), and 8(*b*) are views showing an example filter assembly and an example impurity storage device used in the laundry treatment apparatus shown in FIG. 6.
Figure 8:
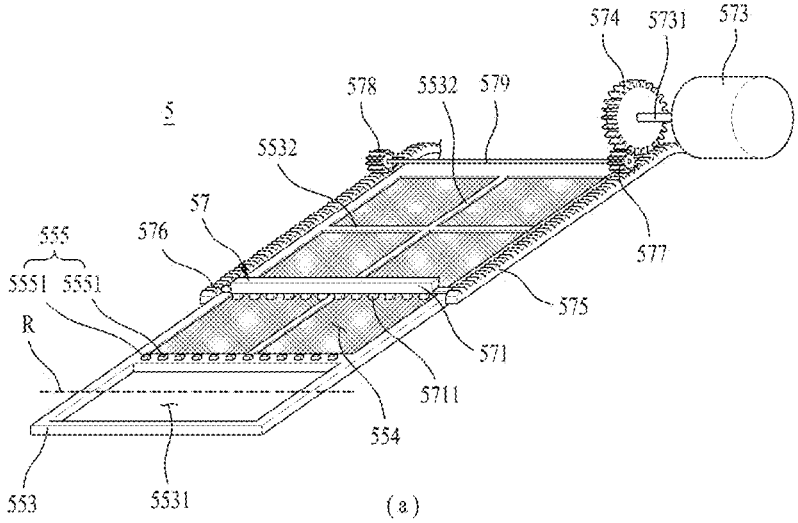
Figure 8:
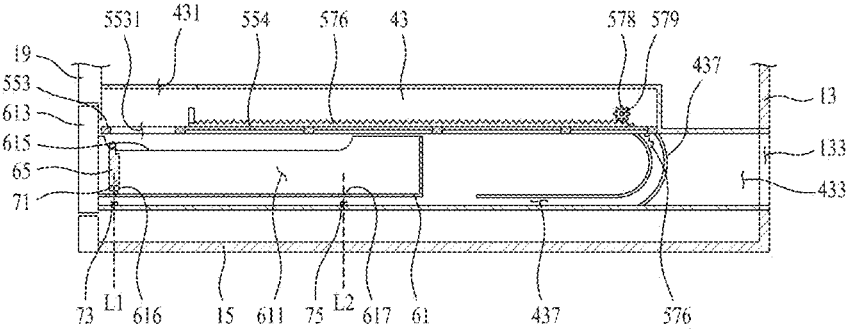

As shown in FIGS. 6, 7, and 8(*a*), the impurity storage device 6 is retractable from the discharge duct 43 through the storage device insertion hole 191, and the filter assembly 5 includes the filter unit 55 which is secured within the discharge duct 43 to filter air discharged from the drum 2 and the impurity remover unit 57 configured to move impurities remaining on the filter unit 55 to the impurity storage device 6.

Considering the configuration of the filter assembly 5 with reference to FIGS. 8(*a*) and 8(*b*), the filter assembly 5 may include the filter unit 55 secured within the discharge duct 43 to extend in a longitudinal direction of the discharge duct 43, and the impurity remover unit 57 configured to reciprocate within the discharge duct 43 and serving to move impurities remaining on the filter unit 55 to the impurity storage device 6.

The filter unit 55 is positioned higher than the discharge hole 433 of the discharge duct 43 and is located between an upper surface of the impurity storage device 6 and the duct connection hole 431.

Accordingly, air introduced into the discharge duct 43 through the duct connection hole 431 first passes through the filter unit 55, and thereafter is discharged outward from the cabinet 1 through the discharge hole 433.

The filter unit 55 includes a filter frame 553 secured within the discharge duct 43 to extend in a longitudinal direction of the discharge duct 43, and a filter 554 secured to the filter frame 553.

The filter frame 553 may have an impurity discharge aperture 5531 located above the impurity storage device 6, and a plurality of frame through-holes over which the filter 554 is disposed. A grid-shaped rib 5532 may be disposed at the frame through-holes to support the filter 554.

The impurity remover unit 57 may include a brush located on the filter frame 553 to come into contact with the filter 554, and a brush drive unit configured to reciprocate the brush in a longitudinal direction of the filter frame 553.

The brush may include a brush body 571 disposed on the filter frame 553 to extend in a width direction of the filter frame 553, and brush bosses 5711 formed at the brush body 571 to come into contact with the filter 554.

The plurality of brush bosses 5711 may be spaced apart from one another by a predetermined distance and may be fixed at the brush body 571.

The brush drive unit may include a brush rack, to which the brush body 571 is secured, the brush rack being movable in a longitudinal direction of the filter frame 553, and a brush motor 573 that moves the brush rack.

The brush rack may include a first brush rack 575 and a second brush rack 576 respectively arranged at opposite longitudinal sides of the filter frame 553. In this case, the filter frame 553 may further be provided with rack support portions (e.g., in the form of accommodation recesses) by which the respective racks 575 and 576 are supported.

The brush motor 573 is provided at the exterior of the discharge duct 43 and serves to move the brush racks 575 and 576 placed within the discharge duct 43. One of the brush racks 575 and 576 may be directly engaged with a motor gear 574 that is coupled to a rotating shaft 5731 of the brush motor 573, or may be connected to the motor gear 574 with a brush rack gear 577 or 578 interposed therebetween, as shown in FIG. 8(*a*).

As shown in FIG. 8(*a*), there are provided two brush rack gears including a first brush rack gear 577 engaged with the first brush rack 575 and a second brush rack gear 578 engaged with the second brush rack 576, the first brush rack gear 577 and the second brush rack gear 578 being connected to each other via a connection shaft 579.

In this case, the first brush rack gear 577 is engaged with the motor gear 574 that is coupled to the rotating shaft 5731 of the brush motor 573. Since the brush motor 573 is secured to the exterior of the discharge duct 43, the motor gear 574 is secured to the rotating shaft 5731 penetrating the discharge duct 43, thereby being engaged with the first brush rack gear 577 within the discharge duct 43.

Accordingly, if a controller controls a rotating direction of the motor gear 574 via the brush motor 573, the laundry treatment apparatus 200 ensures that the impurity remover unit 57 reciprocates above the filter unit 55.

Connecting the first brush rack gear 577 and the second brush rack gear 578 to each other via the connection shaft 579 ensures stable movement of the brush.

If power is supplied to any one of the first brush rack 575 and the second brush rack 576, friction between the brush and impurities remaining on the filter unit 55 may prevent normal reciprocation of the brush. Using the two brush racks 575 and 576 and the two brush rack gears 577 and 578, which are engaged respectively with the brush racks 575 and 576 and are connected to each other via the connection shaft 579, may aid in reducing abnormal reciprocation of the brush.

In addition, the filter assembly 5 may further include a scraper 555 configured to assist in separating the impurities from the filter 554 via the brush bosses 5711 at the impurity discharge aperture 5531.

The scraper 555 may have a plurality of scraper bosses 5551 protruding from an outer periphery of the impurity discharge aperture 5531.

More specifically, a plurality of scraper bosses 5551 may be spaced apart from one another by a predetermined distance in a width direction of the filter frame 553. The scraper bosses 5551 may be located at a portion of the outer periphery of the impurity discharge aperture 5531 facing the discharge hole 433.

Accordingly, the impurities remaining on the filter 554 are moved toward the impurity discharge aperture 5531 by the brush bosses 5711, and thereafter are separated from the brush bosses 5711 by the scraper bosses 5551, thereby being moved into the impurity storage device 6 located below the impurity discharge aperture 5531.

Note that the scraper 555 may be located in a space R inside the impurity discharge aperture 5531.

The respective brush bosses 5711 may be arranged to pass each space between a first scraper boss 5551 and a second scraper boss 5551. This serves to reduce problems (such as overload of the brush motor 573 and obstruction of movement of the brush) caused by friction between the brush bosses 5711 and the scraper bosses 5551.

If the filter assembly 5 is configured in such a manner that the scraper bosses 5551 and the brush bosses 5711 come into contact with each other, the respective scraper bosses 5551 may have a slope at one side thereof facing the discharge hole 433 of the discharge duct 43.

In the case of the filter assembly 5 having the above-described configuration, the first brush rack 575 and the second brush rack 576 are moved rearward of the filter frame 553 (toward the discharge hole 433 of the discharge duct 43) during movement of the brush 571 and 5711, which may cause interference between the first and second brush racks 575 and 576 and the discharge duct 43 according to the length or configuration of the discharge duct 43.

To reduce interference between the first and second brush racks 575 and 576 and the discharge duct 43, rack guides 437 (see FIG. 5(*b*)) may be placed within the discharge duct 43. The rack guides 437 are configured to receive the first brush rack 575 and the second brush rack 576 respectively as the first brush rack 575 and the second brush rack 576 are moved rearward of the filter frame 553.

The rack guides 437 are respectively arranged at opposite later surfaces of the discharge duct 43 and serve to guide the first brush rack 575 and the second brush rack 576 forward of the discharge duct 43 after the first brush rack 575 and the second brush rack 576 are moved rearward of the discharge duct 43.

Accordingly, even if the length of the discharge duct 43 is not sufficient to receive the first brush rack 575 and the second brush rack 576 moved rearward of the filter frame 553, interference between the first and second brush racks 575 and 576 and the discharge duct 43 may be prevented during movement of the brush 571 and 5711.

Hereinafter, the configuration of the impurity storage device 6 will be described with reference to FIG. 7.

The impurity storage device 6 includes the housing 61 configured to be retracted from the discharge duct 43 through the storage device insertion hole 191. The housing 61 may be a hexahedral housing, one side of which faces the filter assembly 5 and is open. The housing 61 provides the storage space 611 in which impurities are stored.

That is, the housing 61 is located below the filter unit 55 at a position to ensure that impurities moved through the impurity discharge aperture 5531 are stored in the housing 61.

The handle 613 may be formed at a front surface of the housing 61 so as to be seated on the filter support panel 19, in order to facilitate insertion or retraction of the housing 61 into or from the discharge duct 43.

In addition, the impurity storage device 6 may further include a compression unit 65 configured to compress impurities stored in the housing 61, and a compression unit drive unit 69 configured to reciprocate the compression unit 65 within the housing 61.

The compression unit 65 may include a compression plate 651 located within the housing 61, and through-holes 653 perforated in the compression plate 651.

The through-holes 653 serve to prevent reduction in the filtration capacity of the filter assembly 5 due to movement of the compression plate 651.

More specifically, the compression plate 651 serves to compress impurities within the housing 61 via reciprocation thereof within the housing 61. If the compression plate 651 has no through-holes 653, the compression plate 651 prevents air introduced into the housing 61 after passing through the filter unit 55 from moving toward the discharge hole 433, which may result in reduction in the filtration capacity of the filter assembly 5. Accordingly, the through-holes 653 formed in the compression plate 651 serve to promote filtration capacity.

The compression unit drive unit 69 may serve to reciprocate the compression unit 65 within the housing 61 and may be adapted to move along with the compression unit 65.

To this end, the compression unit drive unit 69 may be secured to the compression unit 65 via the shaft support portion 67.

The compression unit drive unit 69 may include a motor 691 located at the exterior of the housing 61, a rotating shaft 6911 of the motor 691 penetrating the housing 61, and a motor gear 693 coupled to the rotating shaft 6911 and engaged with a rack 695 that is arranged at the exterior of the housing 61 in a longitudinal direction of the housing 61.

The housing 61 has a shaft penetration region 615 to allow the rotating shaft 6911 to penetrate the housing 61. The shaft penetration region 615 may take the form of a slit cut in one surface of the housing 61, or a recess indented from an upper end of one surface of the housing 61.

If the compression unit 65 is adapted to be moved in a longitudinal direction of the housing 61, the compression unit drive unit 69 may also be moved in a longitudinal direction of the housing 61. Therefore, the shaft penetration region 615 may be formed in a longitudinal surface of the housing 61 as shown in FIG. 7.

The rack 695 may be secured to the longitudinal surface of the housing 61, or may be secured to a housing flange 618 extending from the longitudinal surface of the housing 61. The motor gear 693 is secured to the rotating shaft 6911 of the motor 691 and is located at the exterior of the housing 61 to thereby be engaged with the rack 695.

In the compression unit drive unit 69 having the above-described configuration, the shaft support portion 67 may include a shaft receiving housing 671 which is secured to the compression plate 651 such that the rotating shaft 6911 of the motor 691 is rotatably supported by the shaft receiving housing 671.

The shaft receiving housing 671 may have the shape of a hollow cylinder and may be secured to the compression plate 651.

In this case, the rotating shaft 6911 is inserted into the shaft receiving housing 671 through a shaft penetration hole 673 formed in the shaft receiving housing 671. A shaft flange 6913 is formed at the rotating shaft 6911 at a position within the shaft receiving housing 671 to prevent the rotating shaft 6911 from being separated from the shaft penetration hole 673.

Accordingly, if the controller controls a rotating direction of the rotating shaft 6911, the motor gear 693 is moved along the rack 695, causing the compression plate 651 to reciprocate within the storage space 611 of the housing 61. In this way, impurities within the storage space 611 may be compressed against a rear surface of the housing 61.

Further, the laundry treatment apparatus 200 may further include a storage quantity sensing unit that judges the quantity of impurities stored within the housing 61. The storage quantity sensing unit may judge the quantity of impurities stored within the housing 61 by sensing a position of the compression plate 651, and thus the storage quantity sensing unit will hereinafter be referred to as a position sensing unit 7.

Referring to FIG. 8(*b*), the position sensing unit 7 may include a magnetism generator 71 (e.g., a magnet) secured to the compression plate 651, and at least two magnetism sensors 73 and 75 fixed in the discharge duct 43 to sense a position of the compression plate 651 by sensing magnetic force generated by the magnetism generator 71.

The magnetism generator 71 may be a permanent magnet or an electromagnet. The magnetism sensors 73 and 75 may be reed switches that generate an ON-OFF control signal using magnetism provided by the magnetism generator 71 to transmit the control signal to the controller.

The magnetism sensors may include a first magnetism sensor 73 that senses whether or not the compression plate 651 is located at a preset initial position (a first reciprocation threshold position L1 of the compression unit 65), and a second magnetism sensor 75 that judges whether or not the storage quantity of impurities exceeds a preset storage quantity.

The initial position may be set to any position within the housing 61 so long as the compression plate 651 does not hinder movement of impurities introduced into the housing 61 through the impurity discharge aperture 5531. FIG. 8(*b*) shows the case in which the initial position is set to a front surface of the housing 61 (e.g., a surface of the housing 61 where the handle 613 is located).

Once the impurity storage device 6 is inserted into the discharge duct 43, the first magnetism sensor 73 and the magnetism generator 71 may face each other through a first hole 616 perforated in a bottom surface of the housing 61.

The second magnetism sensor 75 is positioned to judge a maximum quantity of impurities that may be stored in the housing 61. Once the impurity storage device 6 is inserted into the discharge duct 43, the second magnetism sensor 75 and the magnetism generator 71 may face each other through a second hole 617 perforated in the bottom surface of the housing 61.

The maximum quantity of impurities that may be stored in the housing 61 may be set to a position where drying efficiency is deteriorated (e.g., at a second reciprocation threshold position L2).

Accordingly, the controller may check whether or not the first magnetism sensor 73 senses the magnetism generator 71 before operation of the laundry treatment apparatus 200, thereby checking whether or not the compression plate 651 is located at an initial position and whether or not the impurity storage device 6 is mounted in the discharge duct 43.

When judging that the impurity storage device 6 is mounted in the discharge duct 43, the controller controls periodic cleaning of the filter 554 using the impurity remover unit 57 while supplying air into the drum 2 via the air supply unit 3. In this case, the controller controls a rotating direction of the rotating shaft 6911 provided at the motor 691, thereby causing reciprocation of the compression plate 651 within the housing 61.

That is, the controller may control the motor 691 of the compression unit drive unit 69 by rotating the rotating shaft 6911 of the motor 691 clockwise or counterclockwise when the first magnetism sensor 73 senses the magnetism generator 71, and changing a rotating direction of the rotating shaft 6911 when the second magnetism sensor 75 senses the magnetism generator 71.

In the above-described process, the controller may check whether or not the second magnetism sensor 75 senses the magnetism generator 71, thereby judging the quantity of impurities stored within the housing 61.

Accordingly, the controller may request that the user remove impurities (stop operation of the rotating shaft 6911 of the motor 691) via an alarm device (e.g., a display device and/or a speaker) if the second magnetism sensor 75 does not sense the magnetism generator 71.

In addition, the controller may control the motor 691 of the compression unit drive unit 69 to allow the compression plate 651 to begin reciprocation within the housing 61 after the brush 571 and 5711 of the impurity remover unit 57 is moved to the impurity discharge aperture 5531, thus causing introduction of impurities into the housing 61.

This serves to move introduced impurities to the rear surface of the housing 61 and then compress the impurities against the rear surface of the housing 61.

With use of the impurity storage device 6 having the above-described configuration, since the compression unit drive unit 69 is configured to reciprocate at the outside of the housing 61, the discharge duct 43 may define a motor receiving region (435, see FIG. 7) in which the compression unit drive unit 69 is received.

Figure 9:
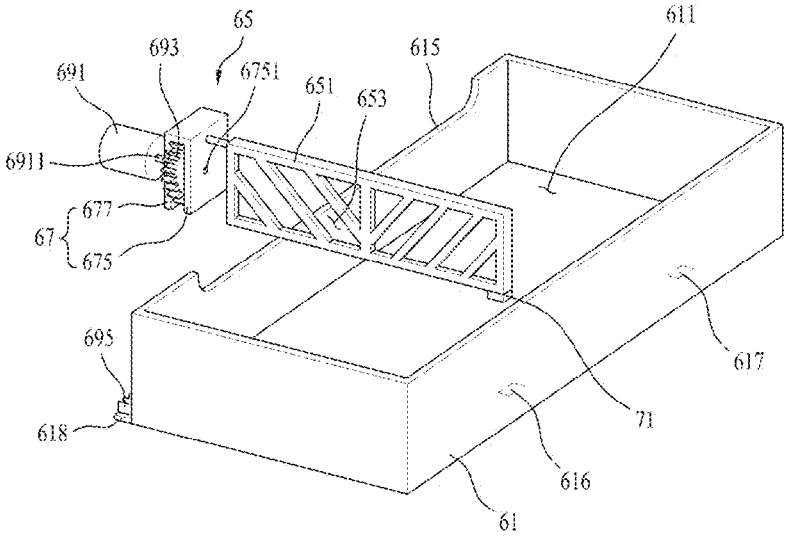
FIG. 9 is a view showing an example compression unit provided in an impurity storage device.

FIG. 9 illustrates another example impurity storage device 6. The impurity storage device 6 shown in FIG. 9 is different from the impurity storage device 6 shown in FIG. 7 in terms of a configuration of the shaft support portion 67.

More specifically, the shaft support portion 67 includes a first flange 675 secured to the compression plate 651, and a second flange 677 spaced apart from the first flange 675 by a predetermined distance.

In this case, the rotating shaft 6911 of the motor 691 penetrates the second flange 677 and is rotatably inserted into a shaft receiving recess 6751 of the first flange 675, and the motor gear 693 is located in a space between the first flange 675 and the second flange 677 and is coupled to the rotating shaft 6911.

Hereinafter, another example filter assembly 5 will be described with reference to FIGS. 10(*a*) and 10(*b*).

The filter assembly 5 has a feature that the brush motor 573 of the impurity remover unit 57 is moved along with the brush.

In some examples, the filter assembly 5 includes the filter unit 55 placed in the discharge duct 43 to filter air, and the impurity remover unit 57 configured to move impurities remaining on the filter unit 55 into the housing 61 of the impurity storage device 6.

The filter unit 55 includes the filter frame 553 secured within the discharge duct 43 at a position above the housing 61 and the discharge hole 433, and the filter 554 secured to the filter frame 553.

The filter frame 553 has the impurity discharge aperture 5531 through which impurities separated from the filter 554 by the impurity remover unit 57 are discharged into the housing 61, and the grid-shaped rib 5532 configured to support the filter 554.

The scraper 555 may further be provided at the outer periphery of the impurity discharge aperture 5531.

The impurity remover unit 57 includes the brush located on the filter frame 553, and the brush drive unit that reciprocates the brush in a longitudinal direction of the filter frame 553.

The brush may consist of the brush body 571 in the form of a cylinder, and the brush bosses 5711 protruding from the brush body 571 to come into contact with the filter 554.

The brush bosses 5711 protruding from the brush body 571 may be arranged in a width direction of the filter frame 553.

The brush drive unit may include the brush motor 573 located at the exterior of the discharge duct 43, brush motor gears located within the discharge duct 43 and coupled to the rotating shaft 5731 of the brush motor 573 penetrating the discharge duct 43, and brush racks secured to the filter frame 553 to extend in a longitudinal direction of the filter frame 553, the brush racks being engaged respectively with the brush motor gears.

The brush racks may include a first brush rack 575 and a second brush rack 576 respectively fixed at opposite longitudinal sides of the filter frame 553. In this case, the brush motor gears may include a first brush motor gear 574 engaged with the first brush rack 575 and a second brush motor gear 572 engaged with the second brush rack 576.

The first brush motor gear 574 and the second brush motor gear 572 may be connected to each other. FIG. 10 shows an example in which the first brush motor gear 574 and the second brush motor gear 572 are connected to each other via the rotating shaft 5731 of the brush motor 573.

Figure 10:
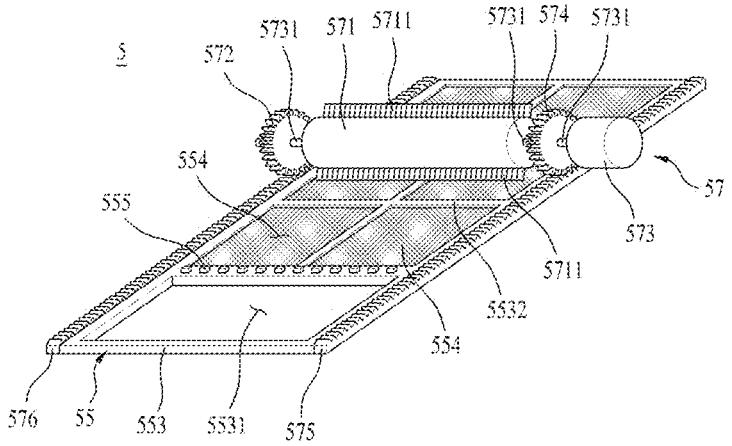
FIGS. 10(*a*) and 10(*b*) are views showing another example filter assembly used in the laundry treatment apparatus shown in FIG. 6.
Figure 10:
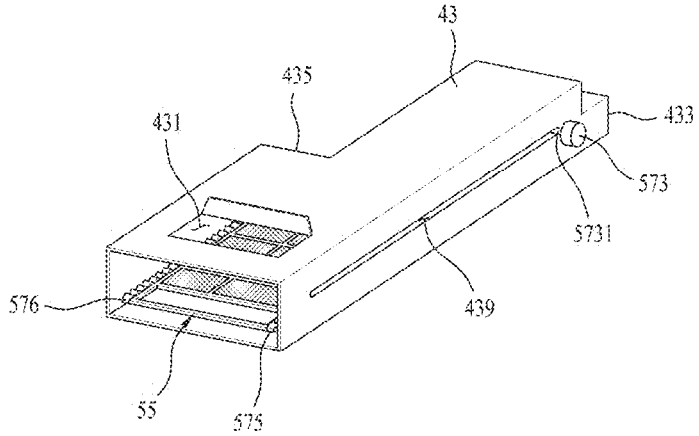

More specifically, the rotating shaft 5731 of the brush motor 573 is inserted into a slit 439 (see FIG. 10(*b*)) that is cut in the outer peripheral surface of the discharge duct 43 in a longitudinal direction of the discharge duct 43. The rotating shaft 5731 has a sufficient length to penetrate the brush body 571 and serves to connect the first brush motor gear 574 and the second brush motor gear 572 to each other. In this case, the brush body 571 is rotatably secured to the rotating shaft 5731.

Alternatively, the rotating shaft 5731 may be connected to a shaft that is configured to penetrate the brush body 571 to connect the first brush motor gear 574 and the second brush motor gear 572 to each other.

Accordingly, if the controller operates the brush motor 573, the first brush motor gear 574 and the second brush motor gear 572, which are coupled to the rotating shaft 5731, are rotated. Thereby, the brush motor 573 may be moved along the first brush rack 575 and the second brush rack 576 in a longitudinal direction of the filter frame 553.

Once the brush motor 573 is moved, the brush body 571 is moved, causing the brush bosses 5711 formed at the brush body 571 to move impurities remaining on the filter 554 to the impurity discharge aperture 5531.

The impurities moved to the impurity discharge aperture 5531 fall into the impurity storage device 6 below the impurity discharge aperture 5531, thereby being compressed within the housing 61 by the compression unit 65 provided in the impurity storage device 6.

Although the rotating shaft 5731 penetrates the brush body 571, the brush motor 573 does not rotate the brush body 571 via the rotating shaft 5731. Rather, the brush body 571 may be rotated by friction between the filter 554 and the brush bosses 5711 during movement of the brush motor 573.

If the brush body 571 is rotated during movement of the brush motor 573, removal of impurities remaining on the filter 554 may be difficult.

Therefore, to restrict rotation of the brush body 571 during movement of the brush motor 573 or to enable removal of impurities remaining on the filter 554 despite rotation of the brush body 571, the brush bosses 5711 may be arranged at opposite ends of the brush body 571, or may radially protrude from an outer peripheral surface of the brush body 571.

The laundry treatment apparatus may further include the impurity storage device 6 as shown in FIGS. 8 and 9. A configuration and a control method of the impurity storage device 6 may be the same as the above description, and thus a detailed description thereof is referenced, rather than repeated.

As is apparent from the above description, a laundry treatment apparatus as described may have increased filtration capacity of a filter.

Further, the laundry treatment apparatus may provide a configuration to increase the quantity of hot air to be supplied into a drum in which laundry is received and to increase the filtration capacity of a filter, thereby being usable as a commercial drying machine.

Further, the laundry treatment apparatus may judge whether or not a filter is mounted in the laundry treatment apparatus and judge the quantity of impurities remaining on the filter.

In addition, the laundry treatment apparatus may inform a user of a cleaning time of a filter based on the quantity of impurities remaining on the filter.

Furthermore, a laundry treatment apparatus may have a structure defining an impurity storage space that is independently separable.

It will be apparent that, although examples have been shown and described above, the disclosure is not limited to the above-described examples, and various modifications and variations can be made by those skilled in the art without departing from the spirit and scope of the appended claims. Thus, it is intended that modifications and variations are included in the present disclosure and covered by the appended claims.

What is claimed is:

1. A laundry treatment apparatus comprising:

a cabinet defining an external appearance of the laundry treatment apparatus;

a drum rotatably supported within the cabinet and configured to receive laundry therein;

a connection duct into which air inside the drum is discharged;

a discharge duct that extends in a longitudinal direction of the drum and that is connected to the connection duct;

a filter assembly including:

a filter unit located in the discharge duct and configured to filter air introduced into the discharge duct, and an impurity remover unit configured to separate, from the filter unit, impurities remaining on the filter unit; and an impurity storage device that is located at the discharge duct and that is separable from the discharge duct, the impurity storage device being located below the filter unit and being configured to store impurities separated from the filter unit by the impurity remover unit, wherein the cabinet has a storage device insertion hole that communicates with the discharge duct, wherein the impurity storage device passes through the storage device insertion hole based on the impurity storage device being inserted into the discharge duct or separated from the discharge duct, and wherein the discharge duct includes:

a duct connection hole located above the filter unit, wherein air is introduced from the connection duct into the discharge duct through the duct connection hole; and a discharge hole located below the filter unit, wherein air having passed through the filter unit is discharged from the discharge duct to outside of the cabinet through the discharge hole.

2. The apparatus according to claim 1, wherein the filter assembly further includes a first roller and a second roller rotatably supported within the discharge duct and configured to allow movement of the filter unit above the impurity storage device.

3. The apparatus according to claim 2, wherein the first roller includes a first roller body rotatably secured within the discharge duct, and first roller bosses radially protruding from an outer peripheral surface of the first roller body, wherein the second roller includes a second roller body rotatably secured within the discharge duct, and second roller bosses radially protruding from an outer peripheral surface of the second roller body, and wherein the filter unit includes:

a filter having a cylindrical shape with opposite sides that are open, the filter being supported by the first roller and the second roller, and fastening holes defined in the filter such that the first roller bosses and the second roller bosses are inserted into the fastening holes.

4. The apparatus according to claim 3, wherein the impurity remover unit includes a scraper that is secured to the impurity storage device and arranged to contact the filter.

5. The apparatus according to claim 1, wherein the filter unit includes a filter frame secured within the discharge duct, an impurity discharge aperture defined in the filter frame at a position above the impurity storage device, and a filter secured to the filter frame and configured to filter air passing through the discharge duct, and wherein the impurity remover unit is configured to reciprocate along the filter frame and move impurities remaining on the filter to the impurity discharge aperture.

6. The apparatus according to claim 5, wherein the impurity remover unit includes:

a brush located on the filter and arranged to contact the filter;

a brush rack placed within the discharge duct and configured to move in a longitudinal direction of the filter frame, the brush being secured to the brush rack;

a brush motor gear placed within the discharge duct and configured to allow the brush rack to move in a longitudinal direction of the filter frame;

a brush motor provided at an exterior of the discharge duct; and a rotating shaft that is provided at the brush motor, that penetrates the discharge duct, and that serves to rotate the brush motor gear based on force generated by the brush motor.

7. The apparatus according to claim 6, wherein the impurity remover unit further includes a brush rack gear configured to connect the brush rack and the brush motor gear to each other, wherein the brush rack includes a first brush rack and a second brush rack provided respectively at opposite sides of the filter frame, and wherein the brush rack gear includes a first brush rack gear configured to couple the first brush rack and the brush motor gear to each other, and a second brush rack gear engaged with the second brush rack, the first brush rack gear and the second brush rack gear being connected to each other via a connection shaft.

8. The apparatus according to claim 6, wherein the filter assembly further includes a scraper provided at an outer periphery of the impurity discharge aperture or inside the impurity discharge aperture to separate, from the brush, impurities remaining on the brush.

9. The apparatus according to claim 8, wherein the scraper is provided at an outer periphery of the impurity discharge aperture.

10. The apparatus according to claim 8, wherein the scraper is provided inside the impurity discharge aperture.

11. The apparatus according to claim 6, wherein the discharge duct further includes a rack guide located below the filter frame and configured to assist the brush rack in being received in the discharge duct.

12. The apparatus according to claim 5, wherein the discharge duct further includes a slit that extends in a longitudinal direction of the filter frame, and wherein the impurity remover unit includes:

a brush motor provided at an exterior of the discharge duct;

a rotating shaft provided at the brush motor and inserted into the discharge duct through the slit;

a brush located within the discharge duct and arranged to contact an upper portion of the filter, the rotating shaft penetrating the brush;

a brush rack that is located within the discharge duct and that extends in a longitudinal direction of the filter frame; and a brush motor gear placed within the discharge duct and engaged with the brush rack, the brush motor gear being secured to the rotating shaft.

13. The apparatus according to claim 12, wherein the brush rack includes a first brush rack and a second brush rack that are provided at opposite sides of the filter frame and that extend in a longitudinal direction of the filter frame, and wherein the brush motor gear includes a first brush motor gear engaged with the first brush rack and a second brush motor gear engaged with the second brush rack.

14. The apparatus according to claim 5, wherein the impurity storage device includes:

a housing separable from the discharge duct, the housing being located below the impurity discharge aperture;

a compression unit located in the housing and configured to compress impurities introduced into the housing through the impurity discharge aperture; and a compression unit drive unit configured to reciprocate the compression unit within the housing.

15. The apparatus according to claim 14, wherein the compression unit includes a compression plate located within the housing and a shaft support portion secured to the compression plate such that the compression unit drive unit is connected to the shaft support portion, and wherein the compression unit drive unit includes:

a motor located at an exterior of the housing, that has a rotating shaft configured to penetrate the housing, and that is rotatably secured to the shaft support portion, a motor gear coupled to the rotating shaft and located at the exterior of the housing, and a rack that is provided at the exterior of the housing and that extends in a longitudinal direction of the housing, the rack being engaged with the motor gear.

16. The apparatus according to claim 15, wherein through-holes are defined in the compression plate.

17. The apparatus according to claim 14, further comprising a sensor configured to sense whether the compression unit reaches a reciprocation threshold position to indicate whether a maximum quantity of impurities are stored in the housing.

18. The apparatus according to claim 14, further comprising:

a first sensor configured to sense whether the compression unit reaches a first reciprocation threshold position to indicate whether the housing is located in the discharge duct; and a second sensor configured to sense whether the compression unit reaches a second reciprocation threshold position to indicate whether a maximum quantity of impurities are stored in the housing.

* * * * *